US008839967B2

(12) United States Patent
Schneider et al.

(10) Patent No.: US 8,839,967 B2
(45) Date of Patent: Sep. 23, 2014

(54) CRANE FOR HANDLING A LOAD HANGING ON A LOAD CABLE

(75) Inventors: Klaus Schneider, Hergatz (DE); Oliver Sawodny, Stuttgart (DE); Joerg Neupert, Korntal-Muenchingen (DE); Eckard Arnold, Ilmenau (DE); Karl Lukas Knierim, Stuttgart (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 835 days.

(21) Appl. No.: 12/832,498

(22) Filed: Jul. 8, 2010

(65) Prior Publication Data

US 2011/0006025 A1 Jan. 13, 2011

(30) Foreign Application Priority Data

Jul. 8, 2009 (DE) ..... 10 2009 032 267

(51) Int. Cl.
*B66C 13/06* (2006.01)

(52) U.S. Cl.
CPC ..... *B66C 13/063* (2013.01)
USPC ..... 212/272

(58) Field of Classification Search
USPC ..... 212/272, 275, 203, 256, 308, 284
See application file for complete search history.

(56) References Cited

U.S. PATENT DOCUMENTS 6,039,193 A * 3/2000 Naud et al. ..... 212/270
7,831,333 B2 * 11/2010 Sawodny et al. ..... 700/213

FOREIGN PATENT DOCUMENTS

| | | |
|---|---|---|
| DE | 10064182 | 5/2002 |
| DE | 60019794 | 3/2006 |
| JP | 2003515513 | 5/2003 |
| WO | 97/45357 | 12/1997 |
| WO | 02/00543 | 1/2002 |

OTHER PUBLICATIONS

Machine translation from Espacenet.com of WO 9745357 performed Jan. 27, 2013.*
Machine translation from Espacenet.com of DE 10064182 performed Jan. 27, 2013.*
Second Office Action from State Intellectual Property Office of the People's Republic of China, Jul. 29, 2014.

* cited by examiner

*Primary Examiner* — Emmanuel M Marcelo
*Assistant Examiner* — Justin Stefanon
(74) *Attorney, Agent, or Firm* — Dilworth & Barrese, LLP.

(57) ABSTRACT

The present invention relates to a crane for handling a load hanging on a load cable, comprising a slewing gear for rotating the crane, a luffing gear for luffing up the boom, and a hoisting gear for lowering or lifting the load hanging on the load cable, with a control unit for calculating the actuation of slewing gear, luffing gear and/or hoisting gear, wherein the calculation of the actuation commands for actuating slewing gear, luffing gear and/or hoisting gear is effected on the basis of a desired movement of the load indicated in Cartesian coordinates.

13 Claims, 6 Drawing Sheets

CRANE FOR HANDLING A LOAD HANGING ON A LOAD CABLE

BACKGROUND OF THE INVENTION

The present invention relates to a crane for handling a load hanging on a load cable, comprising a slewing gear for rotating the crane, a luffing gear for luffing up the boom, and a hoisting gear for lowering or lifting the load hanging on the load cable. The crane includes a control unit for calculating the actuation of slewing gear, luffing gear and/or hoisting gear. Advantageously, the control unit comprises a load pendulum damping, which by suitable actuation of slewing gear, luffing gear and/or hoisting gear attenuates an oscillation of the load during a movement of the crane.

Such crane is known for example from DE 100 64 182. The input of the control commands, the generation of the desired trajectories and the calculation of the actuation of slewing gear, luffing gear and hoisting gear is effected in cylindrical coordinates. The calculation of the suitable actuation of slewing gear, luffing gear and/or hoisting gear for load pendulum damping is expensive and relatively inaccurate.

SUMMARY OF THE INVENTION

It is the object of the present invention to provide a crane for handling a load hanging on a load cable with an improved crane controller.

In accordance with the invention, this object is solved by a crane according to the description herein. The crane in accordance with the invention comprises a slewing gear for rotating the crane, a luffing gear for luffing up the boom, and a hoisting gear for lowering or lifting the load hanging on the load cable. The crane includes a crane controller with a control unit for calculating the actuation of slewing gear, luffing gear and/or hoisting gear. Advantageously, the control unit comprises a load pendulum damping. In accordance with the invention the control unit is configured such that the calculation of the actuation commands for actuating slewing gear, luffing gear and/or hoisting gear is effected on the basis of a desired movement of the load indicated in Cartesian coordinates. This involves the advantage that the calculation on the basis of the desired movement in Cartesian coordinates is simplified and improved considerably. In particular, a simpler and more efficient load pendulum damping can be realized on the basis of the desired movement of the load in Cartesian coordinates.

Advantageously, the load pendulum damping of the control unit is based on the inversion of a physical model of the load hanging on the load cable and of the crane, wherein the inverted physical model converts a given movement of the load hanging on the load cable in Cartesian coordinates into actuation signals for the slewing gear, luffing gear and/or hoisting gear. The physical model comprises the dynamics of the load hanging on the load cable, in particular the pendulum swing dynamics, so that by inverting the model an extremely efficient load pendulum damping can be realized. The calculation in Cartesian coordinates allows a quasi-static decoupling of the hoisting movement in z-direction from the movements in the horizontal, i.e. in x- and y-direction. This provides for a simpler inversion of the model.

The crane of the invention advantageously comprises one or more sensors for determining one or more measured variables concerning the position and/or movement of the load and/or the crane, in particular for determining one or more of the variables cable angle radial, cable angle tangential, luffing angle, slewing angle, cable length and the derivatives thereof, wherein the measured variable or variables are included in the inversion of the physical model. In particular, a plurality of these variables, advantageously all of these variables are included in the inversion of the physical model. The feedback of the measured state variables provides for an inversion of the physical model, which otherwise would be invertible only with the greatest effort or not at all.

The crane of the invention furthermore comprises one or more sensors for determining one or more measured variables concerning the position and/or movement of the load and/or the crane, in particular for determining one or more of the variables cable angle radial, cable angle tangential, luffing angle, slewing angle, cable length and the derivatives thereof, wherein the measured variable or variables are fed back into the control unit. Independent of the inversion of the model, the feedback of the measured state variables also is of great advantage for stabilizing the actuation.

Advantageously, a first transformation unit is provided, which on the basis of the measured variable or variables calculates the actual position and/or actual movement of the load in Cartesian coordinates, in particular one or more of the variables position in x, y and z, velocity in x, y and z, acceleration in x and y, jerk in x and y. The first transformation unit thus allows a comparison of the actual position and/or actual movement of the load with the desired position and/or desired movement of the load available in Cartesian coordinates. Beside the actual position of the load, the actual speed of the load and possibly higher derivatives advantageously are calculated in Cartesian coordinates.

The sensor signals correspond to measured values in crane coordinates or in cable coordinates such as the variables cable angle radial, cable angle tangential, luffing angle, slewing angle and cable length and the derivatives thereof, from which the actual position and/or actual movement of the load is calculated by the first transformation unit in Cartesian coordinates. The luffing angle and the slewing angle are available as measured variables in crane coordinates. The cable angle, on the other hand, is available in cable coordinates, which are measured with respect to an axis directed vertically downwards from the boom head. The first transformation unit requires a transformation of these coordinate systems into Cartesian coordinates of the load.

The crane in accordance with the present invention advantageously comprises one or more cable angle sensors, wherein the measured values of the one or more cable angle sensors are fed back into the control unit. The cable angle sensors provide for a feedback of the pendular movement into the control unit and in particular into the pendulum damping. This provides a closed control circuit by which the control unit of the invention and in particular the load pendulum damping is stabilized.

In particular, the first transformation unit calculates the actual position and/or the actual movement of the load in Cartesian coordinates on the basis of the measured values measured by the one or more cable angle sensors. Beside the actual position of the load, the derivative of the actual position and possibly further derivatives can also be calculated. Further measured variables can be included in the calculation of the actual position and/or actual movement of the load. In particular, the luffing angle, the slewing angle and/or the cable length as well as possibly the derivatives thereof can be considered as measured variables.

The crane controller advantageously furthermore comprises an input unit for entering control commands by an operator and/or by an automation system, wherein between input unit and control unit a second transformation unit is provided, which calculates the desired movement of the load in Cartesian coordinates on the basis of the control commands. The input of the control commands hence furthermore is effected in crane coordinates. The crane coordinates advantageously comprise the slewing angle of the crane, the luffing angle of the boom or the outreach and the hoisting height. These coordinates represent the natural coordinate system of the crane of the invention, so that an input of the control commands in these coordinates is possible intuitively. The second transformation unit therefore transforms a desired movement of the load in crane coordinates into a desired movement of the load in Cartesian coordinates.

Alternatively, however, an input of the desired movement of the load in Cartesian coordinates is also possible. In particular, when the crane is actuated by remote control, an input in Cartesian coordinates can be easier for the operator, in particular when he is present e.g. at the hoisting site. The second transformation unit thus can be omitted.

Furthermore advantageously, the crane of the invention includes one or more sensors for determining measured variables with respect to the position and/or movement of the crane, in particular for determining the luffing angle and/or the slewing angle, wherein the second transformation unit is initalized with reference to the measured variable or variables. It thereby is ensured that a correct transformation of the crane coordinates into Cartesian coordinates is effected. The initialization of the second transformation unit with reference to the measured variable or variables each can be effected e.g. when switching on the crane controller.

The crane controller of the crane of the invention furthermore advantageously comprises a path planning module, which from the control commands of the input unit generates trajectories serving as input variables for the control unit. The path planning module therefore calculates a desired movement of the load from the control commands entered by an operator.

Advantageously, the trajectories are generated in crane coordinates, so that the second transformation unit is arranged between path planning module and control unit. The crane coordinates advantageously are the cylindrical coordinates of the crane, i.e. the slewing angle, the luffing angle or the outreach and the hoisting height. In these coordinates, the generation of the trajectories is particularly easy, since the system constraints also exist in these coordinates.

Advantageously, the trajectories are optimally generated in the path planning module from the control commands in consideration of the system constraints.

Advantageously, the control unit furthermore considers the dynamics of the load hanging on the load cable, in order to attenuate oscillations of the load. This can be effected in particular in the load pendulum damping of the control unit, in order to attenuate pendular oscillations of the load. In addition, oscillations of the load in hoisting direction possibly can also be taken into account and attenuated.

Advantageously, the control unit is based on the inversion of a physical model of the load hanging on the load cable and of the crane. The physical model advantageously describes the movement of the load in dependence on the actuation of slewing gear, luffing gear and/or hoisting gear. By inverting the model, the actuation of the respective gears thus is obtained on the basis of a desired trajectory of the load.

The model advantageously takes into account the oscillation dynamics of the load hanging on the load cable. This results in an efficient damping of oscillations of the load, in particular an efficient load pendulum damping. In addition, the control unit can easily be adapted to different cranes.

Advantageously, the physical model is nonlinear. This is important, as many of the decisive effects in load pendulum damping are of a nonlinear nature.

Advantageously, the model allows a quasi-static decoupling of the vertical movement of the load in Cartesian coordinates. This quasi-static decoupling of the vertical movement of the load in hoisting direction from the movement of the load in horizontal directions provides for a simplified and improved calculation of the actuation of slewing gear, luffing gear and/or hoisting gear. In particular, this allows a simpler load pendulum damping.

The quasi-static decoupling of the vertical movement of the load in addition provides for directly actuating the vertical movement of the load, while the horizontal movement is actuated via the load pendulum damping.

In the crane of the invention it can therefore be provided that the control unit actuates the hoisting gear directly with reference to control commands of an operator and/or an automation system, while the actuation of the slewing gear and of the luffing gear is effected via the load pendulum damping. The control system of the invention thereby can be realized more easily and at lower costs. In addition, higher safety standards are satisfied, since in terms of safety other demands are placed on the hoisting movement than on the movement of the load in horizontal direction. In accordance with the invention, the operator and/or the automation system therefore can directly actuate the speed of the hoisting gear, while for actuating the slewing gear and the luffing gear a desired movement of the load first is generated from the inputs of the operator and/or the automation system, from which the load pendulum damping calculates an actuation of the hoisting gear and of the luffing gear, which avoids or attenuates load pendulum oscillations.

The drives of the crane in accordance with the invention can be e.g. hydraulic drives. The use of electric drives likewise is possible. The luffing gear can be realized e.g. via a hydraulic cylinder or via a retracting mechanism which moves the boom via a system of cables.

Beside the crane, the present invention furthermore comprises a crane controller for actuating the slewing gear, the luffing gear and/or the hoisting gear of a crane. The crane controller includes a control unit for calculating the actuation of stewing gear, luffing gear and/or hoisting gear. The control unit advantageously furthermore includes a load pendulum damping. In accordance with the invention the control unit is configured such that the calculation of the actuation commands for actuating slewing gear, luffing gear and/or hoisting gear is effected on the basis of a desired load movement indicated in Cartesian coordinates. The crane controller advantageously is configured such as has already been set forth above with respect to the crane. Advantageously, the crane controller is a computer-implemented crane controller.

The present invention furthermore comprises a corresponding method for actuating a crane.

In particular, the present invention comprises a method for actuating a crane for handling a load hanging on a load cable, comprising a slewing gear for rotating the crane, a luffing gear for luffing up the boom, and a hoisting gear for lowering or lifting the load hanging on the cable, wherein the calculation of the actuation commands for actuating slewing gear, luffing gear and/or hoisting gear is effected on the basis of a desired load movement indicated in Cartesian coordinates. As set forth already with respect to the crane, the calculation of the actuation commands on the basis of a desired load movement indicated in Cartesian coordinates provides for a simplified and improved actuation. In particular, a load pendulum damping can be performed when calculating the actuation commands for actuating slewing gear, luffing gear and/or hoisting gear, by means of which pendular movements of the load are attenuated. The load pendulum damping advantageously is effected in consideration of the dynamics of the load hanging on the load cable, in particular in consideration of the pendulum dynamics of the load hanging on the load cable, in order to attenuate spherical pendular oscillations of the load by a suitable actuation of slewing gear and luffing gear.

Advantageously, the method is performed in the same way as set forth above in detail with respect to the crane or the crane controller. In particular, the method of the invention is a method for actuating a crane as set forth above.

BRIEF DESCRIPTION OF THE DRAWINGS

The present invention will now be explained in detail with reference to an embodiment and drawings, in which.

DESCRIPTION OF THE PREFERRED EMBODIMENTS

Figure 1:
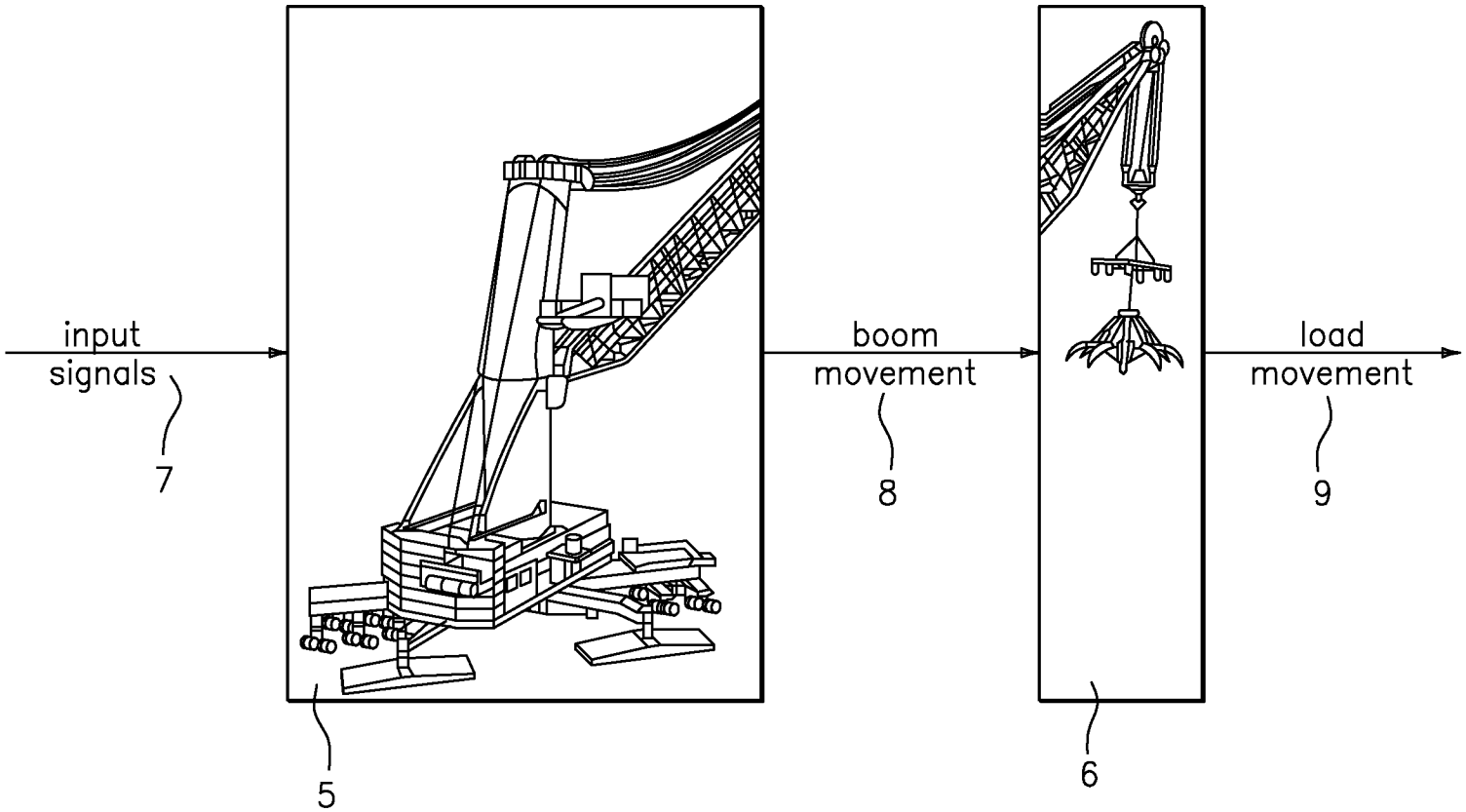
FIG. 1: shows the structure of the physical model used for the actuation.

An embodiment of a crane of the invention, a method for controlling the crane and a corresponding crane controller in which this method is implemented will now be explained in detail below.

The essential control tasks in the automation of the crane operation according to the method of the invention for controlling a crane are the load pendulum damping and load velocity tracking control. For this purpose a nonlinear dynamic crane model is used, which combines the equations of movement of the cable-guided load and the simplified drive dynamics. Based on the flatness property of the crane model, a linearizing control law is obtained by state feedback. The generation of smooth and realizable reference trajectories is formulated as an optimal control problem. The control system is integrated in the software of a crane, in particular of a mobile harbor crane.

The essential objectives of the crane automation in accordance with the present invention include the increase of the efficiency and safety in loading processes. The crane operation and external disturbances cause weakly attenuated pendular load movements. Another problem in the control of slewing cranes as compared to gantry cranes is the nonlinear coupling of slewing and luffing movements. An active load pendulum damping and a precise sequence of the desired load velocities, which are specified by hand lever signals of the operator, are the essential control tasks for the mobile harbor crane.

The problem of trajectory tracking is solved by deriving control laws which linearize the nonlinear crane system based on the state information (linearization by state feedback). In the design of the control, the flatness property of the MIMO system is demonstrated and used. The resulting linearized system is stabilized in addition by asymptotic output controls. Due to the model-based controller design, all parameters are reproduced analytically, and the control concept can easily be adapted to different configurations and crane types.

The application of the model-based, nonlinear design methods requires sufficiently smooth reference trajectories which can be realized with respect to the input and state constraints of the system. Therefore, the tracking problem is formulated as an optimal control problem which is solved online, in order to generate the realizable reference trajectories for the exactly linearized system. The generation of trajectories can be regarded as a model predictive control (MPC). The formulation of the problem of the optimal control in the flat coordinates reduces the effort in the numerical solution.

In the following paragraph, a dynamic model of the crane is derived from the equations of movement of the load hanging on a cable and from approximations of the drive dynamics. Subsequently, the differential flatness of the crane model is shown and a nonlinear flatness-based control law is derived. The formulation and numerical solution of the problem of trajectory generation is illustrated as an optimal control problem. The measurement results from the realization of the control strategy on a mobile harbor crane are represented in the last paragraph.

Dynamic Crane Model

The present invention is employed in a crane with a boom 1, which is articulated to the tower 2 of the crane so as to be luffed up about a horizontal luffing axis. For luffing up the boom 1, a boom cylinder is arranged between the tower and the boom. The tower is rotatable about a vertical axis of rotation. For this purpose, the tower is arranged on an uppercarriage which is rotatable with respect to an undercarriage about the vertical axis of rotation by means of a slowing gear. Furthermore, the hoisting gear for lifting the load is arranged on the uppercarriage. The hoisting cable is guided from the hoisting winch arranged on the uppercarriage via deflection pulleys on the tower tip and on the boom tip 3 to the load. In the embodiment, the undercarriage includes a traveling gear, so that the crane is traversable. In the embodiment, the crane is a mobile harbor crane. The same has e.g. a loading capacity of up to 200 t, a maximum outreach of 60 m, and a cable length of up to 80 m.

The dynamic model of the boom crane is derived by dividing the entire system in two sub-systems, as shown in FIG. 1. The first sub-system is the rigid crane structure 5, which consists of the crane tower 2 and the boom 1. This sub-model has two degrees of freedom. The slewing angle $\phi_s$ and the erection angle $\phi_l$. The second sub-system 6 represents the load hanging on the cable. The suspension point is the tip of the boom. As shown in FIG. 1, the crane structure acts on the cable-guided load through movements of the boom tip, which leads to spherical pendular load movements. With reference to the input signals 7 for the drives, the physical model of the crane structure describes the movement 8 of the boom tip, and with reference to the movement 8 of the boom tip the physical model of the load hanging on the crane cable describes the movement of the load 9, the model taking into account pendular movements of the load.

Dynamics of the Crane Structure

The crane structure is set in motion by hydraulic motors for the rotary movement and by a hydraulic cylinder for luffing the boom. Assuming that the hydraulic pump has a first order delay behavior and the slewing speed $\phi_s$ is proportional to the oil stream delivered by the pump, the equation of movement for slewing is obtained as $$\ddot{\varphi} + \frac{1}{T_s}\dot{\varphi}_s = \underbrace{\frac{2\pi K_s}{\frac{i_s V T_s}{d}}}_{} u_s \tag{1}$$

The parameters of equation (1) are the time constant $T_s$, the proportional constant $K_s$ between the input signal $u_s$ and the oil throughput, the transmission ratio $i_s$ and the motor volume V. The derivative of the dynamic model of the luffing movement again is based on the assumption of the first order delay behavior between the input signal $u_l$ and the throughput of the pump. The dynamics of the hydraulic cylinder can be neglected, but the actuator kinematics must be taken into account. The resulting equation of movement reads as follows:

$$\ddot{\varphi}_l + \frac{1}{T_l}\dot{\varphi}_l - \underbrace{\frac{C_2}{C_1^2}}_{e}\dot{\varphi}_1^2 = \underbrace{\frac{K_l C_1}{T_l A}}_{k} u_l \tag{2}$$

with the time constant $T_l$, the proportional constant $K_l$, the cross-sectional area A and the geometrical constants $C_1$ and $C_2$.

Dynamics of the Load Hanging on the Cable

Figure 2:
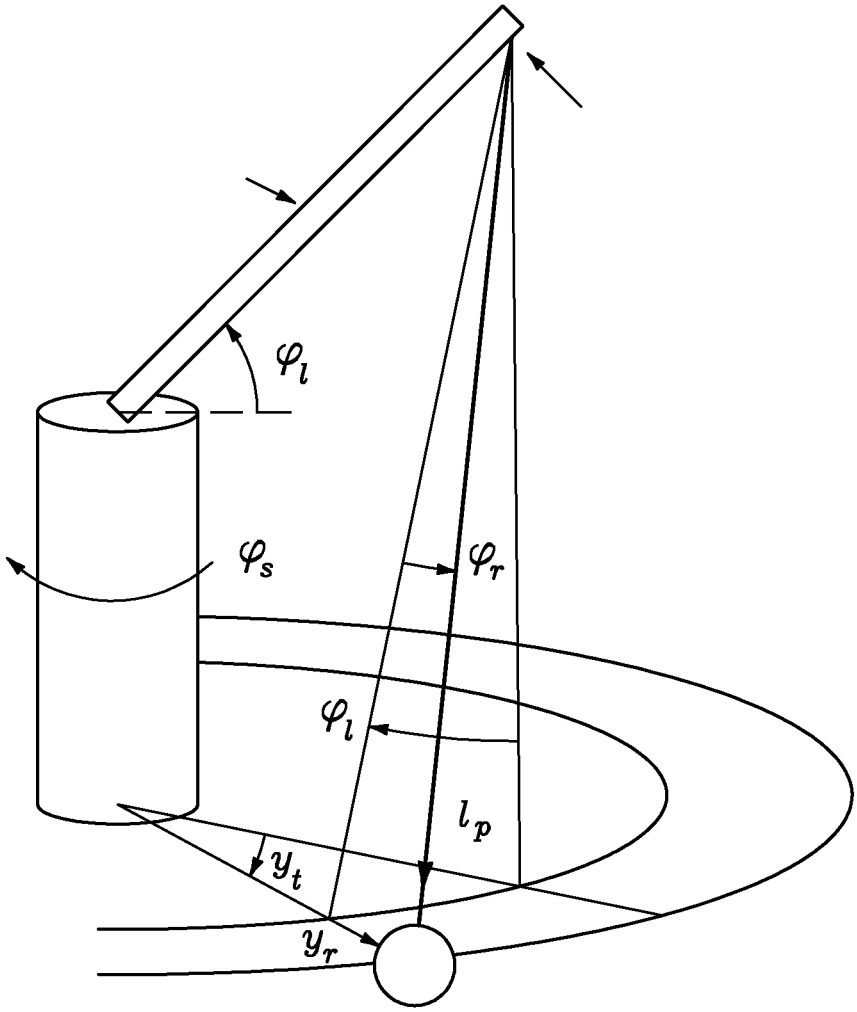
FIG. 2: shows a schematic representation of the crane and of the load hanging on the load cable by indicating the relevant coordinates.

The second sub-system represents a spherical pendulum mounted on the boom tip. Pendular movements can be triggered either by movements of the crane structure (first subsystem) or by external forces. As shown in FIG. 2, the load position in relation to the boom tip depends on the Cardan cable angles $\phi_t$ and $\phi_r$ and on the cable length $l_R$. To derive the equations of movement for the load hanging on the cable, the Euler/Lagrange formalism is used. When the generalized coordinates are defined as $$q=[\phi_t \phi_r l_R]^T \tag{3}$$

the following equations of movement are obtained:

$$a_0 + a_1\ddot{\varphi}_t + a_2\ddot{\varphi}_s + a_3\ddot{\varphi}_l + a_4\dot{\varphi}_s^2 + a_5\dot{\varphi}_l^2 + a_6\dot{\varphi}_s\dot{\varphi}_l + a_7\dot{\varphi}_r\dot{\varphi}_s + a_8\dot{\varphi}_t\dot{\varphi}_l + a_9\dot{\varphi}\dot{l}_R + a_{10}\dot{\varphi}_s\dot{l}_R + a_{11}\dot{\varphi}_r\dot{\varphi}_t = 0 \tag{4}$$

$$b_0 + b_1\ddot{\varphi}_t + b_2\ddot{\varphi}_s + b_3\ddot{\varphi}_l + b_4\varphi_s^2 + b_5\dot{\varphi}_l^2 + b_6\dot{\varphi}_s\dot{\varphi}_l + b_7\dot{\varphi}_t\dot{\varphi}_s + b_8\dot{\varphi}_r\dot{\varphi}_l + b_9\dot{\varphi}\dot{l}_R + b_{10}\dot{\varphi}_s\dot{l}_R + b_{11}\dot{\varphi}_t^2 = 0 \tag{5}$$

$$\ddot{l} + c_1\ddot{\varphi}_s + c_2\ddot{\varphi}_l + c_3\dot{\varphi}_s^2 + c_4\dot{\varphi}_l^2 + c_5\dot{\varphi}_s\dot{\varphi}_l + c_6\dot{\varphi}_t\dot{\varphi}_s + c_7\dot{\varphi}_r\dot{\varphi}_s + c_8\dot{\varphi}_r^2 + c_9\dot{\varphi}_r^2 - c_0 = \left(\frac{F_R}{m_L}\right) \tag{6}$$

The coefficients $a_i$, $b_i$ and $c_j$ ($0 \le i \le 11$, $0 \le j \le 9$) are complex expressions which depend on the system parameters, the erection angle $\phi_l$ and the generalized coordinates (3). The equations (4)-(6) show the complexity of the dynamic submodel with coupling terms such as centrifugal and Coriolis accelerations. In equation (6), a third input $F_R$, which is the force of the cable winch, is considered. By means of the cable winch, the cable length and thus the height of the load with the mass $m_L$ can be changed.

Input-Affine System Representation

The two sub-systems now are combined to an input-affine nonlinear system of the following form:

$$x=f(x)+g(x)u \quad x_0=x(t_0) \tag{7}$$

with the input vector $u=[u_s\ u_l\ F_R]^T$ and the following state vector:

$$x=[\phi_s \dot{\phi}_s \phi_t \dot{\phi}_t \phi_r \dot{\phi}_r \phi_l \dot{\phi}_l l_R \dot{l}_R]^T \tag{8}$$

With the equations of movement (1), (2) and (4)-(6), the vector fields f and g are obtained as:

$$f(x) = \begin{bmatrix} x_2 \\ -\frac{1}{T_s}x_2 \\ x_4 \\ -\frac{1}{T_l}x_4 + ex_4^2 \\ x_6 \\ f_6(x) \\ x_8 \\ f_8(x) \\ x_{10} \\ f_{10}(x) \end{bmatrix} \quad g(x) = \begin{bmatrix} 0 & 0 & 0 \\ o & 0 & 0 \\ 0 & 0 & 0 \\ 0 & e & 0 \\ 0 & 0 & 0 \\ -\frac{a_2}{a_1}d & -\frac{a_3}{a_1}k & 0 \\ -\frac{b_2}{b_1}d & -\frac{b_3}{b_1}k & 0 \\ -c_1 d & -c_2 k & \frac{1}{m_L} \end{bmatrix} \tag{9}$$

wherein $$f_6(x) = \frac{1}{a_1}\left(\frac{a_2}{T_s}x_2 + a_3\left(\frac{1}{T_l}x_4 - ex_4^2\right) - a_4x_2^2 - a_5x_4^2 - a_6x_2x_4 - a_7x_8x_2 - a_8x_6x_4 - a_9x_6x_{10} - a_{10}x_2x_{10} - a_{11}x_8x_6 + a_0\right) \tag{10}$$

$$f_8(x) = \frac{1}{b_1}\left(\frac{b_2}{T_s}x_2 + b_3\left(\frac{1}{T_l}x_4 - ex_4^2\right) - b_4x_2^2 - b_5x_4^2 - b_6x_2x_4 - b_7x_6x_2 - b_8x_8x_4 - b_9x_8x_{10} - b_{10}x_2x_{10} - b_{11}x_6^2 + b_0\right)$$

$$f_{10}(x) = \frac{c_1}{T_s}x_2 + c_2\left(\frac{1}{T_l}x_4 - ex_4^2\right) - c_3x_2^2 - c_4x_4^2 - (c_5x_4 + c_6x_6 + c_7x_6)x_2 - c_8x_6^2 - c_9x_8^2 - c_0$$

The outputs of the nonlinear system are the three elements of the load position in Cartesian coordinates. Thus, the output vector is defined as:

$$y = r_L = [y_x y_y y_z]^T = h(x) = \begin{bmatrix} \cos\varphi_s(\sin\varphi_r l_P + \cos\varphi_l l_B) - \sin\varphi_s \sin\varphi_t \cos\varphi_r l_P \\ -\sin\varphi_s(\sin\varphi_r l_P + \cos\varphi_l l_B) - \cos\varphi_s \sin\varphi_t \cos\varphi_r l_P \\ -\cos\varphi_t \cos\varphi_r l_P + \sin\varphi_l l_B + l_T \end{bmatrix} \tag{11}$$

wherein $l_B$ is the length of the boom, $l_T$ is the height of the point of attachment of the boom, and $l_p$ is the length of the spherical pendulum. In the crane system observed, the pendulum length $l_p$ depends on the cable length $l_R$ and on the erection angle $\phi_l$.

$$l_P = l_R + l_B \sin\phi_l \tag{12}$$

Control Concept

Figure 3:
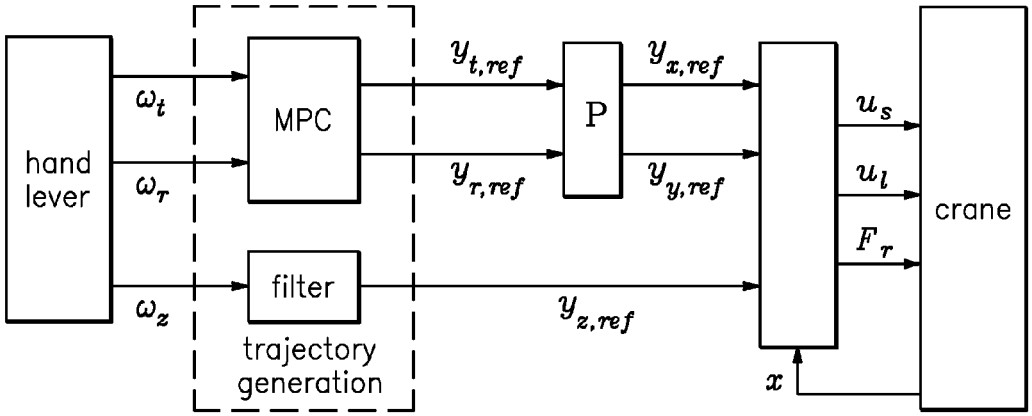
FIG. 3: shows a schematic representation of the control structure of a crane controller in accordance with the invention.

In this paragraph, the realization of a pendulum damping and trajectory tracking concept for boom cranes is represented. As shown in FIG. 3, an input unit 10 is provided, by means of which an operator can enter control commands, e.g.

via a hand lever. Alternatively, the control commands can also be generated by a superordinate automation system which autonomously actuates the crane. From the control commands reference trajectories are generated in a path planning module 11. $\omega_t$ and $\omega_r$ are the desired velocities of the load, which are linked with the slewing and luffing movement of the crane. $\omega_z$ designates the desired hoisting speed of the load. The reference trajectories $y_{t,ref}$ and $y_{r,ref}$ are generated based on a model predictive control (MPC) 12.

Due to the fact that the control law is derived based on the nonlinear model (7), which is present in Cartesian coordinates, these reference trajectories must be transformed from the polar representation into the Cartesian representation. The transformation P, which is implemented by a second transformation unit 14 in accordance with the present invention, not only considers the position, but also higher order derivatives. The reference trajectory for the height of the load $y_{z,ref}$ is generated from the hand lever signal $\omega_z$ by an integrating filter 13 of sufficient order. The control law, which consists of a linearizing and stabilizing part, calculates the input signals of the boom crane. The calculation is effected in a calculation unit 15 of the control unit. The design of the control law is based on a flatness-based approach.

The control unit actuates the drives of the crane 20. Sensors arranged on the crane measure a state x of the system of crane and load, wherein the measurement signals are fed back into the controller via a first transformation unit 16.

Control Design

First of all, the relative degree of the system (7) is determined, in order to check it for its differential flatness. A MIMO system with m inputs and outputs has the vectorial relative degree $r=\{r_1, \ldots, r_m\}$ for all x in the neighborhood of $x_o$, if:

$$\text{(i) } L_{g_j} L_f^k h_i(x_0) = 0 \quad \forall\, 1 \le j \le m \quad \forall\, 1 \le i \le m \quad \forall\, k < r_i - 2 \tag{13}$$

$$\text{(ii) } L_{g_j} L_f^{r_i - 1} h_i(x_0) \neq 0 \quad \forall\, 1 \le i \le m \quad \text{for at least one } j \in \{1, \ldots, m\} \tag{14}$$

and (iii) the matrix m×m:

$$R(x) = \begin{bmatrix} L_{g_1} L_f^{r_1-1} h_1(x) & L_{g_2} L_f^{r_1-1} h_1(x) & \ldots & L_{g_m} L_f^{r_1-1} h_1(x) \\ L_{g_1} L_f^{r_2-1} h_2(x) & L_{g_2} L_f^{r_2-1} h_2(x) & \ldots & L_{g_m} L_f^{r_2-1} h_2(x) \\ \vdots & \vdots & & \vdots \\ L_{g_1} L_f^{r_m-1} h_m(x) & L_{g_2} L_f^{r_m-1} h_m(x) & \ldots & L_{g_m} L_f^{r_m-1} h_m(x) \end{bmatrix} \tag{15}$$

is regular, i.e. rank R $(x_0)$=m, [5]. With system (7) and m=3 the matrix (15) is obtained as:

$$R(x) = \begin{bmatrix} 0 & 0 & \dfrac{\cos\varphi_s \sin\varphi_r - \sin\varphi_s \sin\varphi_t \cos\varphi_r}{m_L} \\ 0 & 0 & -\dfrac{\sin\varphi_s \sin\varphi_r + \cos\varphi_s \sin\varphi_t \cos\varphi_r}{m_L} \\ 0 & 0 & -\dfrac{\cos\varphi_{St} \cos\varphi_{Sr}}{m_L} \end{bmatrix} \tag{16}$$

Since the matrix (16) is not regular, the vectorial relative degree r is not well defined and static decoupling is not possible. However, for all three outputs only the third input $F_R$ appears in the second derivative. Thus, a quasi-static decoupling can be achieved. Therefore, the second derivatives of the outputs are determined as:

$$\ddot{y}_x = \frac{\cos\varphi_s \sin\varphi_r - \sin\varphi_s \sin\varphi_t \cos\varphi_r}{m_L} F_R \tag{17}$$

$$\ddot{y}_x = \frac{\sin\varphi_s \sin\varphi_r + \cos\varphi_s \sin\varphi_t \cos\varphi_r}{m_L} F_R \tag{18}$$

$$\ddot{y}_z = -g - \frac{\cos\varphi_t \cos\varphi_r}{m_L} F_R \tag{19}$$

With equation (19) the control law for the hoisting winch is given as:

$$F_R(x, \ddot{y}_z) = \frac{-m_L}{\cos\varphi_t \cos\varphi_r}\left(\ddot{y}_z + g\right) \tag{20}$$

By replacing the force of the hoisting winch $F_R$ in equations (17) and (18) by the relationship in equation (20), the second derivatives of the outputs $y_x$ and $y_y$ are independent of u, but depend on $\ddot{y}_z$. Further differentiation of the outputs up to the fourth derivative results in:

$$\begin{bmatrix} \dddot{y}_x \\ \dddot{y}_y \end{bmatrix} = F\left(x, u_s, u_l, \ddot{y}_z, \dddot{y}_z, \ddddot{y}_z\right) \tag{21}$$

Since the first two inputs $u_s$ and $u_l$ appear in the fourth derivatives of the outputs, the vectorial relative degree of system (7) is:

$$r=\{r_x=4,\ r_y=4,\ r_z=2\} \tag{22}$$

The sum of the elements of the vectorial relative degree is 10, which is equal to the order of the system. This means that the system (7) is differentially flat. Solving equation (21) according to the inputs and replacing the outputs by the new inputs of the resulting integrator chains provides the following control laws:

$$\begin{bmatrix} u_s \\ u_l \end{bmatrix} = F^{-1}\left(x, v_x, v_y, v_z, \ddot{y}_{z,ref}, \dddot{y}_{z,ref}\right) \tag{23}$$

with $$v_i = \overset{(ri)}{y}_{i,ref} - v_{i,stab} \quad i \in \{x, y, z\} \tag{24}$$

In equation (20) $\ddot{y}_z$ likewise is replaced by the new input $v_z$. However, although the relative degree of output $y_z$ is two, the reference trajectory $y_{z,ref}$ must contain the third and fourth derivatives of the reference position. Therefore, the filter used for generating this trajectory is of the fourth order.

Figure 4:
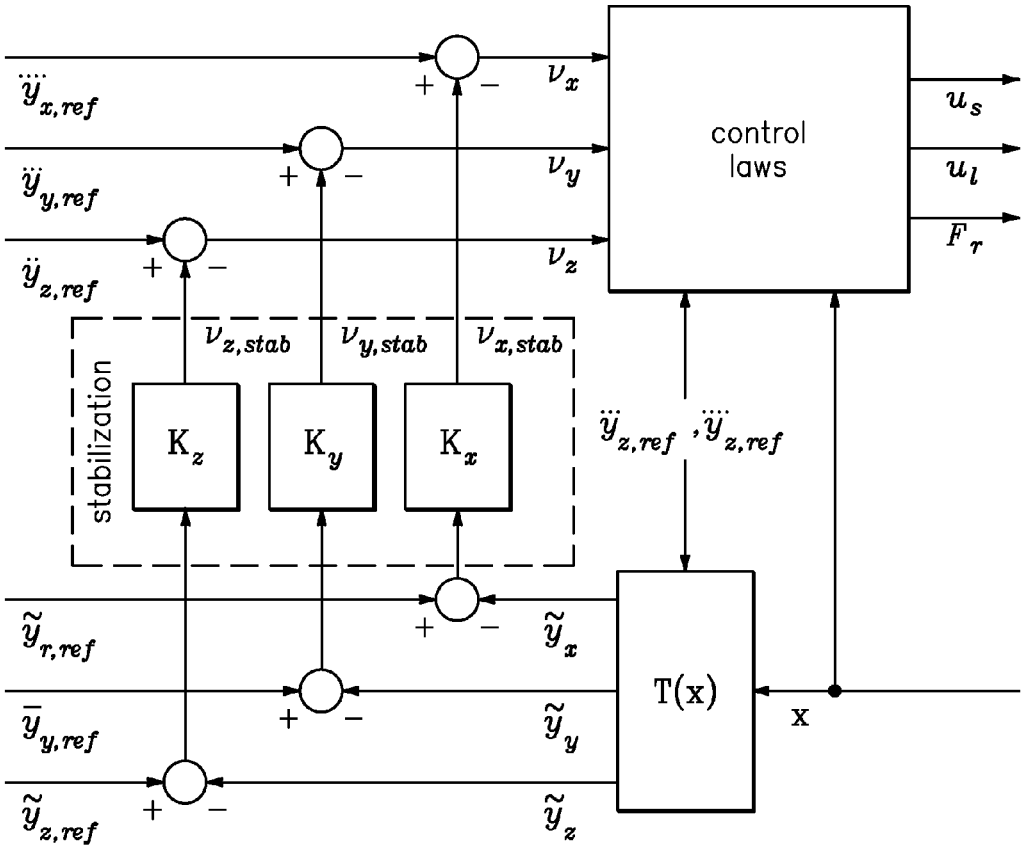
FIG. 4: shows a segment of the control structure of the invention, which in detail shows the feedback of measured values with reference to a second transformation unit.

The linearizing part of the controller now is determined by equations (20) and (23). However, due to model and parameter uncertainties and external influences, a stabilizing feedback loop is constructed. As shown in FIG. 4, the differences between the reference trajectories $$\tilde{y}_{i,ref} = [\, y_{i,ref} \;\; \ldots \;\; \overset{(r_i-1)}{y}_{i,ref} \,]$$

and the corresponding states of the resulting decoupled integrator chains $$\tilde{y}_i = [\, y_i \;\; \ldots \;\; \overset{(r_i-1)}{y}_i \,]$$

are fed back by means of the feedback matrices $K_i$ ($i \in \{x,y,z\}$) in the stabilization (17). Thus, the stabilizing parts of the new inputs are given by:

$$v_{i,stab} = K_i(\tilde{y}_{i,ref} - \tilde{y}_i) i \in \{x,y,z\} \tag{25}$$

The elements of the feedback matrices are determined by pole assignment. With reference to lookup tables, which depend on the cable length, the poles are adapted to the system dynamics. The output vectors $\tilde{y}_i$ are determined by the transformation T(x). This transformation T(x) is implemented by the first transformation unit (16) in accordance with the present invention. The transformation is based on the Byrnes/Isidori normal-form representation.

Trajectory Generation

The underlying idea is the formulation of the problem of trajectory generation as a constrained optimal control problem with finite horizon (open loop) for the integrator chains. The inputs of these integrator chains form the formal control variables for the optimal control problem. Since the constraints of the system are given as simple limits in polar coordinates ($y_t$, $y_r$), the optimal control problem is formulated in the variables $\tilde{y}_{t,ref}$, $\tilde{y}_{r,ref}$. The transformation P by the second transformation unit subsequently is made to convert the optimal reference trajectories into Cartesian coordinates $\tilde{y}_{x,ref}$, $\tilde{y}_{y,ref}$.

The problem of optimal control is solved numerically. In the sense of a model predictive control, the solution procedure is repeated in the next scanning step with shifted horizon, in order to take into account changing specifications (desired velocities of the load $\omega_t$, $\omega_r$).

Figure 5:
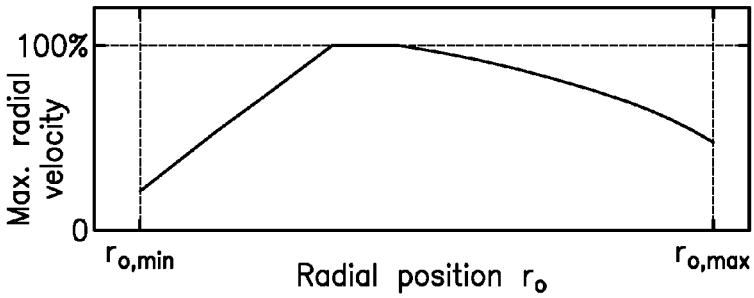
FIG. 5: shows the maximum velocity of the boom head in radial direction in dependence on the outreach of the boom.

The model predictive trajectory generation algorithm handles constraints of the system variables like constraints of the optimal control problem. Constraints result from the limited working space of the crane, which is defined by the minimum and maximum outreach. In addition, constraints of the radial velocity/acceleration and angular velocity/acceleration for the boom tip result from restrictions of the hydraulic actuators. As shown in FIG. 5, the maximum radial velocity of the boom tip depends on the cylinder kinematics and for safety reasons on the outreach. In the optimal control problem, the constraints for the boom tip are interpreted as constraints of the load movement in the respective direction.

$$\begin{bmatrix} y_{r,ref,min} \\ -\dot{y}_{r,ref,max}(y_r) \\ -\ddot{y}_{r,ref,max} \\ -\dot{y}_{t,ref,max} \\ -\ddot{y}_{t,ref,max} \end{bmatrix} \leq \begin{bmatrix} y_{r,ref} \\ \dot{y}_{r,ref} \\ \ddot{y}_{r,ref} \\ \dot{y}_{t,ref} \\ \ddot{y}_{t,ref} \end{bmatrix} \leq \begin{bmatrix} y_{r,ref,max} \\ \dot{y}_{r,ref,max}(y_r) \\ \ddot{y}_{r,ref,max} \\ \dot{y}_{t,ref,max} \\ \ddot{y}_{t,ref,max} \end{bmatrix} \tag{26}$$

The maximum radial velocity, which depends on the outreach as shown in FIG. 5, is approximated by piecewise linear functions. In addition, limited changes of input are utilized as constraint for $\overset{(4)}{y}_{r,ref}$ and $\overset{(4)}{y}_{r,ref}$, in order to avoid high-frequency excitations of the system.

A standard quadratic target function evaluates the square deviation of the angular and radial position and velocity from their reference predictions and the rate of change of the input variables over the finite time horizon $[t_0,t_f]$. The optimization horizon is a setting parameter and should cover the essential dynamics of the system, which is defined by the period length of the pendular load movement. Reference predictions are generated from the hand lever signals of the crane operator for the desired load velocity in tangential and radial direction ($\omega_t$, $\omega_r$).

The continuous, constrained, linear-quadratic optimal control problem is discretized with K time steps and approximated by a quadratic program (QP) in the control and state variables, which can be solved by a standard interior-point algorithm. With this algorithm, the structure of the model equations is utilized in a Riccati-like procedure, in order to obtain a solution of the Newtonian equation of steps with O (K) operations, i.e. the calculation effort increases linearly with the prediction horizon.

Measurement Results

Figure 6:
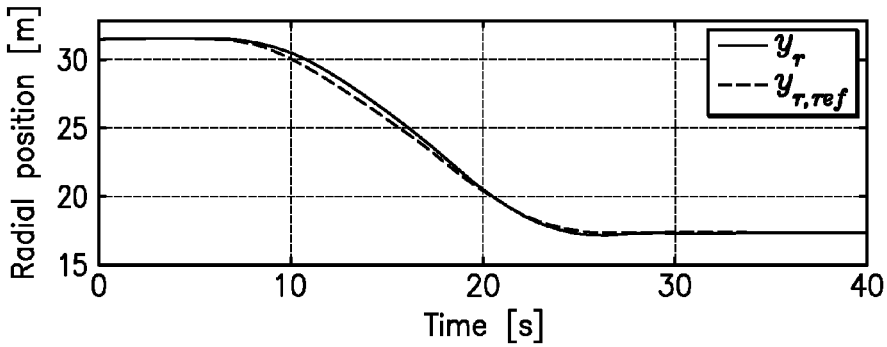
FIG. 6: shows the radial position of the load during a luffing movement of the boom.
Figure 7A:
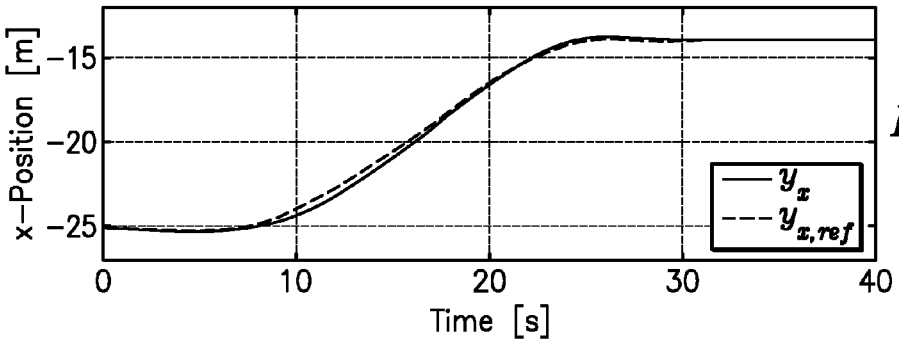
FIGS. 7A and 7B: show the corresponding position of the load in x- and y-direction during the luffing movement.
Figure 7B:
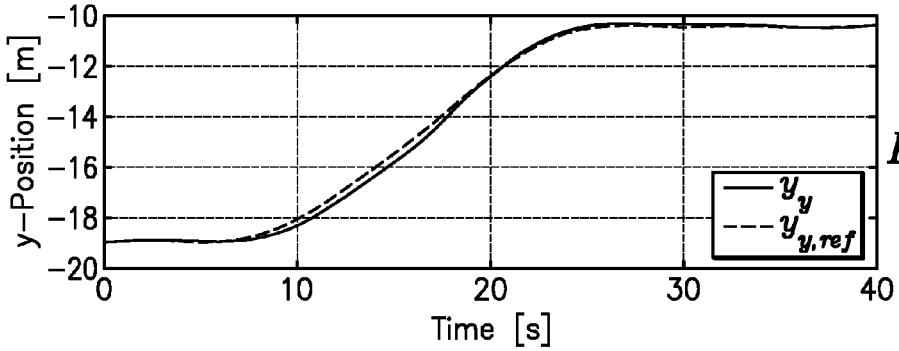

The illustrated control concept is implemented in a mobile harbor crane. As shown in FIG. 6, the first scenario is a pure luffing movement. By luffing the boom, the load is shifted from a radius of 31 m to a radius of 17 m. It can be seen that the radial position of the load $y_r$, which is the distance between the crane mast and the load in the direction of the boom, very accurately follows the reference trajectory $y_{r,ref}$. The tracking behavior of the controlled crane in Cartesian coordinates is shown in FIGS. 7A and 7B.

For the practical realization, only the x- and y-direction is of interest in the embodiment. Due to safety reasons, it is not provided to automatically influence the z-position of the load with the control law (20). Therefore, only the control laws (23) are implemented on the LHM 280. As shown in FIGS. 7A and 7B, a radial reference trajectory with the transformation P leads to reference trajectories in the x- and y-direction, when the slewing angle $\phi_s$ is not zero.

Figure 8A:
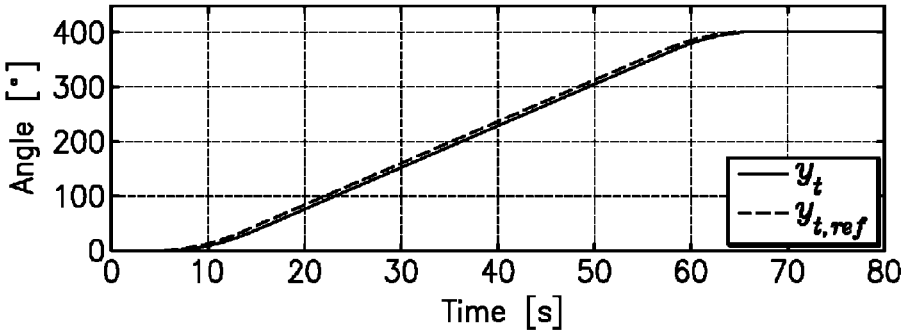
FIGS. 8A, 8B and 8*c*: show the position, velocity and acceleration of the load in direction of rotation during a rotary movement of the crane.
Figure 8B:
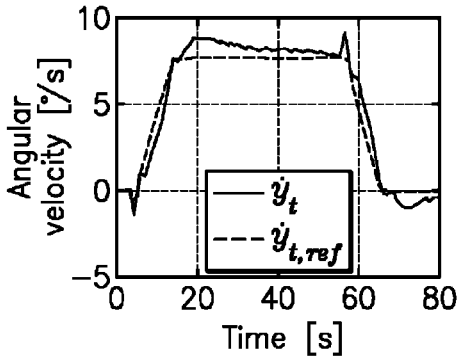
Figure 8C:
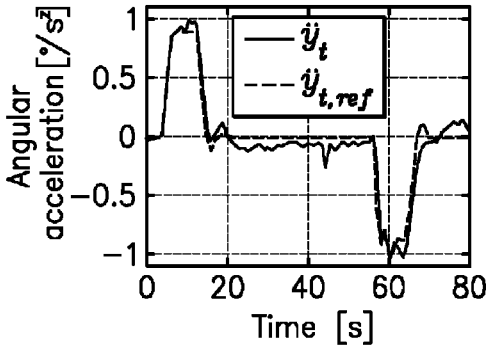

The second maneuver is a rotary movement from 0 to 400°. FIGS. 8A, 8B and 8C show the trajectory tracking behavior for the angular load position, velocity and acceleration. The reference trajectory is generated by the MPC algorithm in consideration of the following constraints:

$$|\dot{y}_{t,ref}| \leq \dot{y}_{t,ref,max} = 8.0°/s, \; |\ddot{y}_{t,ref}| \leq \ddot{y}_{t,ref,max} = 0.9°/s^2$$

Figure 9:
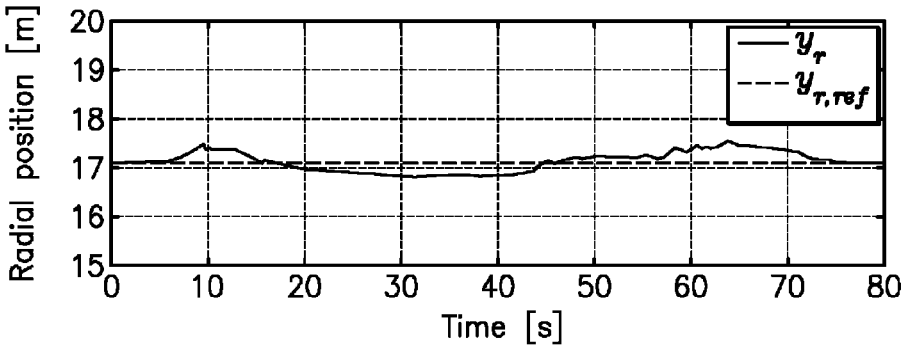
FIG. 9: shows the position of the load in radial direction during the rotary movement of the crane.

The linearizing and stabilizing controller makes the load follow very accurately without essential overshoot of this reference trajectory. The residual pendular load movement likewise is sufficiently small. What is of specific importance is the radial displacement of the load, which occurs as a result of centrifugal forces during a rotary movement. To leave the load on a constant radius during rotary movements, the radial displacement is compensated by the luffing control law $u_l$. As a result, the radial load position is almost constant with errors between the reference trajectory and the measured load position of less than ±0.5 m, see FIG. 9.

Figure 10A:
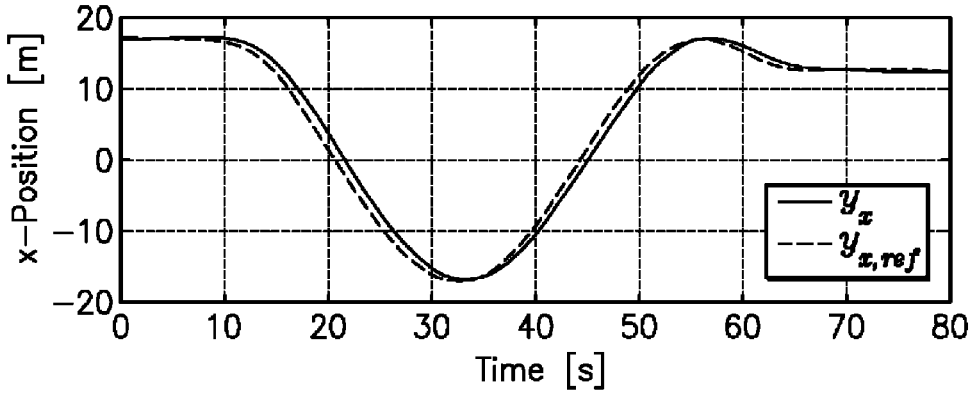
FIGS. 10A and 10B: show the corresponding position of the load in x- and y-direction during the rotary movement of the crane.
Figure 10B:
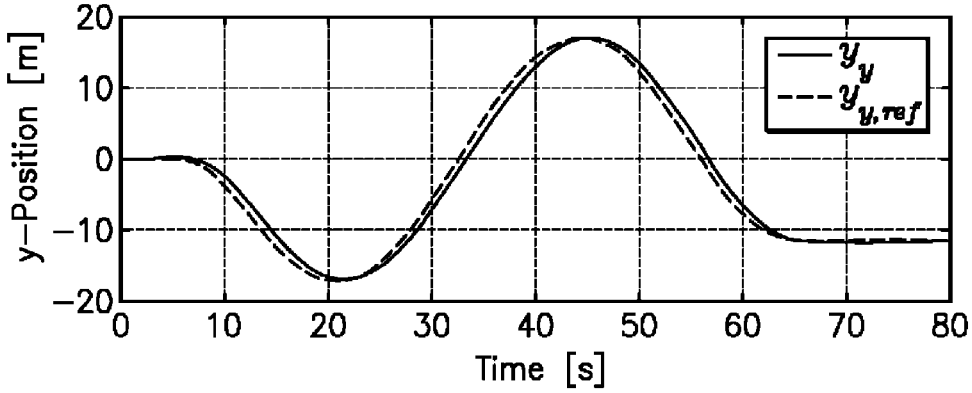

Since the controller concept is designed in Cartesian coordinates based on the flatness property of the nonlinear system with respect to the output vector, FIGS. 10A and 10B show the measured load position in the x- and y-direction and its reference trajectories during the rotary movement. The control quality is as good as the quality in slewing and luffing direction, since the Cartesian representation ($y_x$, $y_y$) is equivalent to the polar representation ($y_t$, $y_r$), wherein $y_t$ is the angle of rotation and $y_r$ is the radius of the load.

The invention claimed is:

1. A crane for handling a load hanging on a load cable from a boom, comprising a slewing gear arranged for rotating the crane, a luffing gear arranged for luffing up the boom, a hoisting gear arranged for lowering or lifting the load hanging on the load cable, and a control unit arranged for calculating actuation commands of at least one of he stewing gear, luffing gear and hoisting gear, wherein the control unit is arranged to dampen pendulum load by calculating only the commands for actuating at least one of the stewing gear, luffing gear and hoisting gear based upon a desired movement of the load indicated in Cartesian coordinates, and inversion of a physical model of the load hanging on the load cable and the crane, the inverted physical model converting a given movement of the load hanging on the load cable in the Cartesian coordinates into actuation signals for at least one of the stewing gear, luffing gear and hoisting gear, whereas the actuation signals are calculated based on the quasi-static decoupling of the hoisting movement in the z-direction from the movement in the horizontal x- and y-direction.

2. The crane according to claim 1, comprising one or more sensors for determining one or more measured variables concerning position and/or movement of the load and/or the crane, in particular for determining one or more of the variables cable angle radial, cable angle tangential, luffing angle, slewing angle, cable length and derivatives thereof, wherein the measured variable or variables are included in the inversion of the physical model.

3. The crane according to claim 1, comprising one or more sensors for determining one or more measured variables concerning position and/or movement of the load and/or the crane, in particular for determining one or more of the variables cable angle radial, cable angle tangential, luffing angle, slewing angle, cable length and derivatives thereof, wherein the measured variable or variables are fed back into the control unit.

4. The crane according to claim 3, wherein a first transformation unit is provided, which on the basis of the measured variable or variables calculates actual position and/or actual movement of the load in Cartesian coordinates, in particular one or more of the variables position in x, y and z, velocity in x, y and z, acceleration in x and y, jerk in x and y.

5. The crane according to claim 1, comprising one or more cable angle sensors, wherein measured values of the one or more cable angle sensors are fed back into the control unit.

6. The crane according to claim 1, comprising an input unit for entering control commands by an operator, wherein between input unit and control unit a second transformation unit is provided, which calculates the desired movement of the load in Cartesian coordinates on the basis of the control commands.

7. The crane according to claim 6, comprising one or more sensors for determining measured variables with respect to position and/or movement of the crane, in particular for determining luffing angle and/or stewing angle, wherein the second transformation unit is initialized with reference to the measured variable or variables.

8. The crane according to claim 1, comprising a path planning module which generates trajectories from control commands of an operator and/or an automation system, which serve as input variables for the control unit.

9. The crane according to claim 8, wherein the trajectories are generated in crane coordinates and a second transformation unit is arranged between path planning module and control unit.

10. The crane according to claim 8, wherein the trajectories are optimally generated in the path planning module from the control commands in consideration of system constraints.

11. The crane according to claim 1, wherein the control unit actuates the hoisting gear directly with reference to control commands of an operator and/or an automation system, while the actuation of the slewing gear and of the luffing gear is effected via the load pendulum damping.

12. The crane according to claim 1 comprising a vertically extending tower rotatably arranged on the slewing gear and with the boom pivotally arranged on the tower about a horizontal luffing axis.

13. A method for actuating a crane for handling a load hanging on a load cable, comprising the steps of slewing or rotating the crane about a vertical axis, luffing up a boom secured to the crane about a horizontal axis, luffing or lowering a load suspended from a cable on the boom, calculating actuation commands for at least one of slowing, luffing and hoisting, and dampening pendulum load by calculating only the commands for actuating at least one of a slowing gear, a luffing gear and a hoisting gear based upon a desired movement of the load indicated in Cartesian coordinates, and inverting a physical model of the load hanging on the load cable and the crane, the inverted physical model converting a given movement of the load hanging on the load cable in the Cartesian coordinates into actuation signals for at least one of the slowing gear, the luffing gear and the hoisting gear, whereas the actuation signals are calculated based on the quasi-static decoupling of the hoisting movement in the z-direction from the movement in the horizontal x- and y-direction.

* * * * *